United States Patent [19]

Beckway

[11] Patent Number: 4,487,136

[45] Date of Patent: Dec. 11, 1984

[54] PALLET LEG FOR A CORRUGATED CARDBOARD PALLET

[75] Inventor: Bruce C. Beckway, River Forest, Ill.

[73] Assignee: Packaging Materials Corporation, Chicago, Ill.

[21] Appl. No.: 453,760

[22] Filed: Dec. 27, 1982

[51] Int. Cl.[3] ..... B65D 19/22; B65D 19/40

[52] U.S. Cl. ..... 108/51.3; 108/51.1

[58] Field of Search ..... 108/51.1, 51.3, 56.1, 108/56.3; 206/386, 599, 600; 248/188

[56] References Cited

U.S. PATENT DOCUMENTS

| | | | |
|---|---|---|---|
| 2,665,807 | 1/1954 | Budd | 206/599 |
| 3,052,397 | 9/1962 | Budd | 206/599 X |
| 3,266,444 | 8/1966 | Budd | 108/51.3 X |

FOREIGN PATENT DOCUMENTS

| | | | |
|---|---|---|---|
| 1470774 | 7/1967 | France | 108/56 A |

*Primary Examiner*—James T. McCall
*Assistant Examiner*—Peter R. Brown
*Attorney, Agent, or Firm*—Robert E. Knechtel

[57] ABSTRACT

A pallet leg for a corrugated cardboard pallet is disclosed, in which tubular leg elements are secured by adhesive to a flat table element. Die-cut finger members are formed in the corrugated cardboard table member at each leg attachment point, and are positioned perpendicular to the table member within an annulus formed by two nesting cylindrical paperboard leg members. The finger members are formed by die-cut lines tangent to a central hole so that a somewhat spiral pattern is formed, much like a camera iris.

2 Claims, 4 Drawing Figures

FIG. 1
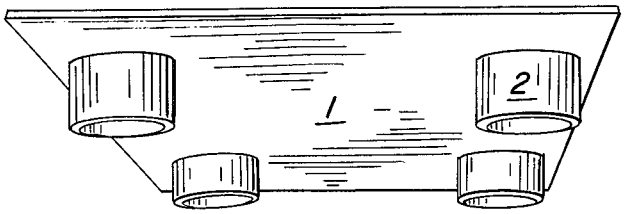
FIG. 2
PRIOR ART
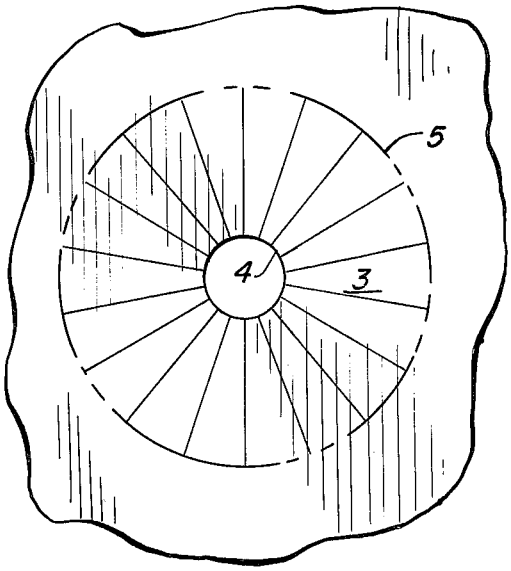
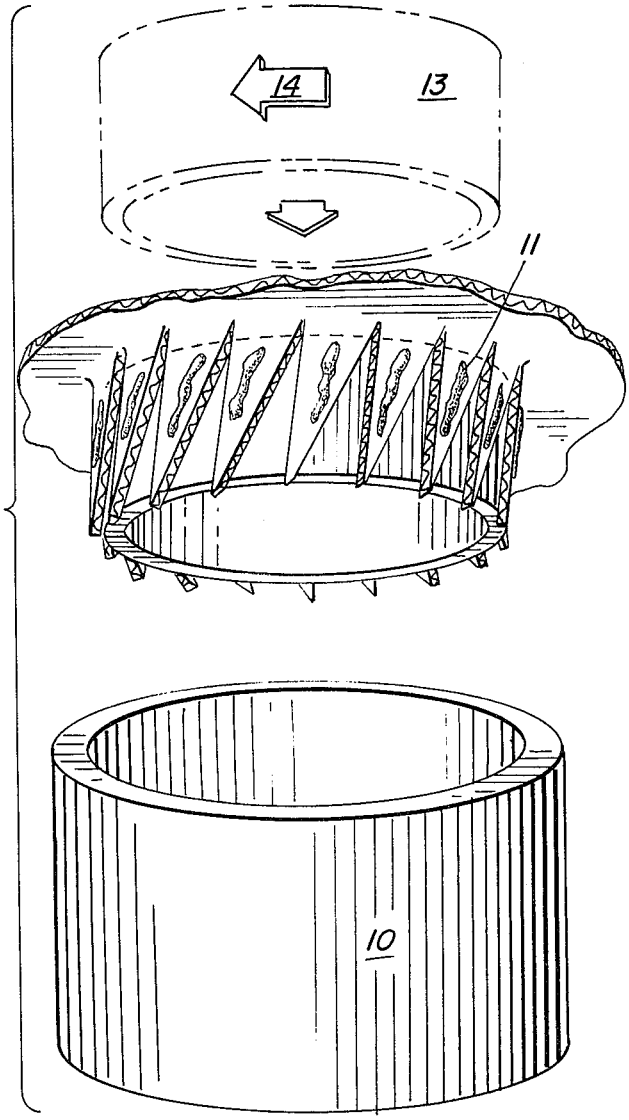
FIG. 4
FIG. 3
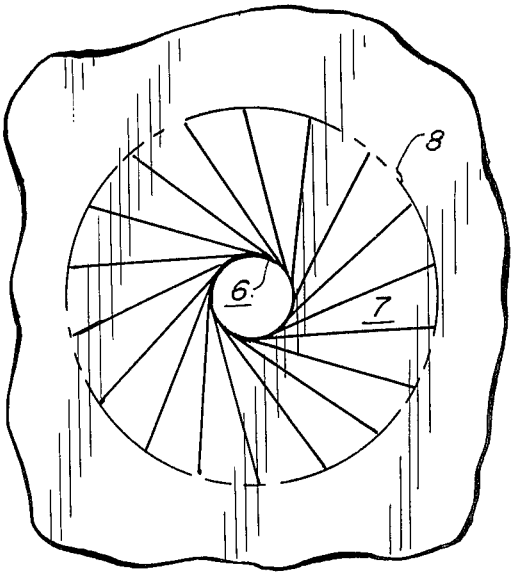

PALLET LEG FOR A CORRUGATED CARDBOARD PALLET

BACKGROUND OF THE INVENTION

The present invention relates to pallets, and in particular to inexpensive and lightweight pallets constructed of corrugated cardboard.

Prior art pallets have employed table members of corrugated cardboard material to which a plurality of leg members are attached. The table member is supported above its resting surface so that the pallet and its contents may be picked up by mechanized equipment such as a forklift truck.

Prior art corrugated pallets have utilized a simple and effective attachment means by which a tubular cardboard leg, usually constructed of spiral laminated paperboard material, is attached to the table member by gluing. Such a prior art construction is exemplified by the Budd U.S. Pat. No. 3,266,444. To effect a strong attachment, the prior art table members have utilized a sunburstshaped die-cut pattern at each attachment point. The die-cut pattern utilizes a central hole with radiating die cuts terminating at an outer radius corresponding to the inner diameter of the pallet leg. The finger members thus formed have blunt tips where they originate from the central hole.

After cutting, the finger members of this prior art design are forced downward into an inner leg member, which is customarily coated with glue prior to its insertion. More glue is applied to the extending fingers, and then the inner leg member is forced into the assembly to retain the fingers in the annulus formed by the concentric leg members. As the Budd U.S. Pat. No. 3,266,444 shows, the finger members extend beyond the lower edge of the inner leg member and are supported only at their bases and not throughout their full length.

DESCRIPTION OF THE DRAWINGS

In the drawings:

FIG. 1 is a completed pallet formed according to the present invention;

FIG. 2 is a plan view of the die-cut leg attachment point of a corrugated pallet table member formed according to the prior art;

FIG. 3 is a plan view similar to FIG. 2 of the die-cut leg attachment point of a corrugated cardboard table member constructed according to the present invention; and FIG. 4 is an exploded view of the improved construction of the present invention, illustrating the inner and outer tubular leg members prior to and during assembly.

DESCRIPTION OF THE INVENTION

Turning to the drawings, there is shown in FIG. 1 a corrugated cardboard pallet 1 formed according to the present invention, having four leg elements 2 attached at its corners. The pallet is shown as it would appear after assembly.

In FIG. 2, the die-cut leg attachment point of the prior art is illustrated. As can be seen from the drawing, a die-cut sunburst pattern defines individual finger members 3 surrounding a central opening 4, and attached at their broad ends by a circular score line 5 which, when the fingers are bent upwards, forms a hinge point for each finger.

According to the present invention, the individual finger members are formed in a substantially spiral pattern as shown in FIG. 3. The central die-cut hole 6 forms the inner apex of generally triangular finger members 7 which, like the prior art construction, have their bases formed by a circular score line 8 which defines a hinge point for each finger. According to the invention, however, the finger members 7 of the invention are formed by die-cut lines which extend from the outer scored circle 8 to meet the inner circle 6 substantially tangentially to its periphery, rather than extending directly to the center of the inner circle 4 as in the prior art design of FIG. 2.

To complete the assembly, the members are arranged in the manner depicted by the exploded view of FIG. 4, with an outer leg member 10 positioned from below. The fingers are preferably pre-coated on their lower surfaces with a bead or other coating of glue 11. Additional glue beads are then applied to the upper surfaces of the finger members 7. An inner leg member 13 is inserted downwardly into the outer leg member 10 with a twisting motion in the direction shown by the arrow 14, causing the fingers 7 to be captured between the leg members 10, 13 to lock the assembly firmly together while the glue sets. As a feature of the invention, the inner leg member 3 is of a length sufficient to overlap substantially the entire surface area of the finger members 7, as shown in FIG. 4.

Alternatively, the inner leg member 13 could be inserted first to displace the fingers 7 into position, and the outer member 10 slipped over them with the same twisting motion 14 to complete the assembly.

According to the invention, the placing of the approximately spiral die-cut lines tangent to the inner circle 6 (FIG. 3) causes them, upon being forced into position by the inner leg element 10, to assume a spiral or angled saw-tooth form as best shown in FIG. 4. When the inner leg element 13 is pressed onto the previous assembly with a rotating motion imparted in the direction shown by the arrow 14, the finger members 7 are firmly adhered to the annulus formed by the concentric inner and outer leg members 10, 13. The leg assembly therefore has substantial strength and cannot easily be moved or dislodged from its position at the corner of the completed pallet 1.

I claim as my invention:

1. In a corrugated cardboard pallet including a table member having tubular leg members comprised of inner and outer leg elements affixed thereto said tubular leg members comprising:

a. a plurality of die-cut finger elements formed in said table member by die-cut lines radiating outward from a central circle and terminating on a circular score line of substantially the same diameter as the inner diameter of the outer leg element;

b. the die-cut lines radiating tangentially outward from the periphery of the inner die-cut circle to meet the outer circular score line, thereby forming a substantially spiral pattern;

c. an inner leg element having a length substantially corresponding to the length of said finger elements;

d. an outer leg element proportioned to receive therein said inner leg element with said finger elements retained in the annulus formed between said outer and inner leg elements, said tubular leg members being provided by placing an outer leg element under said table member and aligned with said circular score line and an inner leg element atop said table member and aligned with said circular score line;

e. said inner leg element being inserted into said outer leg element with said finger elements being captured between said outer and inner leg elements by pressing said inner leg element through said table member into said outer leg element;

f. said finger elements being adhesively secured to both of said outer and inner leg elements over substantially the entire surface area of each said finger element.

2. The method of manufacturing a corrugated cardboard pallet leg element comprising the steps of:

a. forming a plurality of fingers at at least one corner of a corrugated cardboard table member, the fingers consisting of an inner die-cut circle, an outer scored circle line, and a plurality of equally spaced die-cut lines extending inward from the outer scored circle line to the inner die-cut circle substantially tangentially, thereby forming a substantially spiral pattern;

b. applying adhesive to the surfaces of the finger members on each of the opposite sides of the table member;

c. positioning the table member over a tubular outer leg member aligned with the circular score line;

d. positioning an inner leg member atop the table member and aligned with the circular score line;

e. inserting the inner leg member into the outer leg member with the extended finger elements being simultaneously retained in the annulus formed between the outer and inner leg elements by pressing downwardly and rotating the inner leg member through the table member and into the outer leg member;

f. said inner leg member being of a length to substantially overlie the entire surface area of each of said fingers.

* * * * *